US009994988B2

(12) United States Patent
Kim et al.

(10) Patent No.: US 9,994,988 B2
(45) Date of Patent: Jun. 12, 2018

(54) BALANCER OF WASHING MACHINE

(71) Applicant: Samsung Electronics Co., Ltd, Gyeonggi-do (KR)

(72) Inventors: Min Sung Kim, Gyeonggi-do (KR); Jeong Hoon Kang, Seoul (KR); Dong Ha Jung, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days. days.

(21) Appl. No.: 15/027,240

(22) PCT Filed: Oct. 2, 2014

(86) PCT No.: PCT/KR2014/009330
§ 371 (c)(1),
(2) Date: Apr. 4, 2016

(87) PCT Pub. No.: WO2015/050399
PCT Pub. Date: Apr. 9, 2015

(65) Prior Publication Data

US 2016/0258102 A1 Sep. 8, 2016

(30) Foreign Application Priority Data

Oct. 4, 2013 (KR) ..... 10-2013-0118403
Jul. 18, 2014 (KR) ..... 10-2014-0090950

(51) Int. Cl.
*D06F 37/22* (2006.01)

(52) U.S. Cl.
CPC ..... *D06F 37/225* (2013.01); *D06F 2222/00* (2013.01)

(58) Field of Classification Search
CPC ..... D06F 37/22; D06F 2222/00
See application file for complete search history.

(56) References Cited

U.S. PATENT DOCUMENTS 5,806,349 A * 9/1998 Kim ..... D06F 37/245 68/23.2
2012/0017646 A1 1/2012 Chae et al.
2012/0084926 A1 4/2012 Lee et al.
2012/0278996 A1* 11/2012 Park ..... D06F 33/02 8/137

FOREIGN PATENT DOCUMENTS

CN 102443999 A 5/2012
EP 1862577 A2 12/2007
EP 2441872 A2 4/2012
(Continued)

OTHER PUBLICATIONS

International Search Report dated Jan. 26, 2015 in connection with International Application No. PCT/KR2014/009330, 2 pages.
(Continued)

*Primary Examiner* — Joseph L. Perrin

(57) ABSTRACT

Disclosed herein is a washing machine having an improved balancing function. The washing machine includes a cabinet, a drum disposed in the cabinet to be rotatable, a balancer installed at the drum to offset an unbalanced load generated at the drum when the drum is rotated, and at least one magnetic body disposed between the balancer and the drum.

13 Claims, 21 Drawing Sheets

(56) References Cited

FOREIGN PATENT DOCUMENTS

| | | | | | |
|---|---|---|---|---|---|
| GB | 2410750 | A | * | 8/2005 | ..... D06F 37/225 |
| KR | 10-2007-0115286 | | | 12/2007 | |
| KR | 10-2008-0037428 | | | 4/2008 | |
| KR | 10-2010-0044153 | | | 4/2010 | |

OTHER PUBLICATIONS

Office Action dated Mar. 20, 2017 in connection with Chinese Patent Application No. 2014800510430.
European Patent Office, "Supplementary European Search Report," Application No. EP14850705.6, dated Feb. 2, 2017, 8 pages.

* cited by examiner

[Fig. 1]
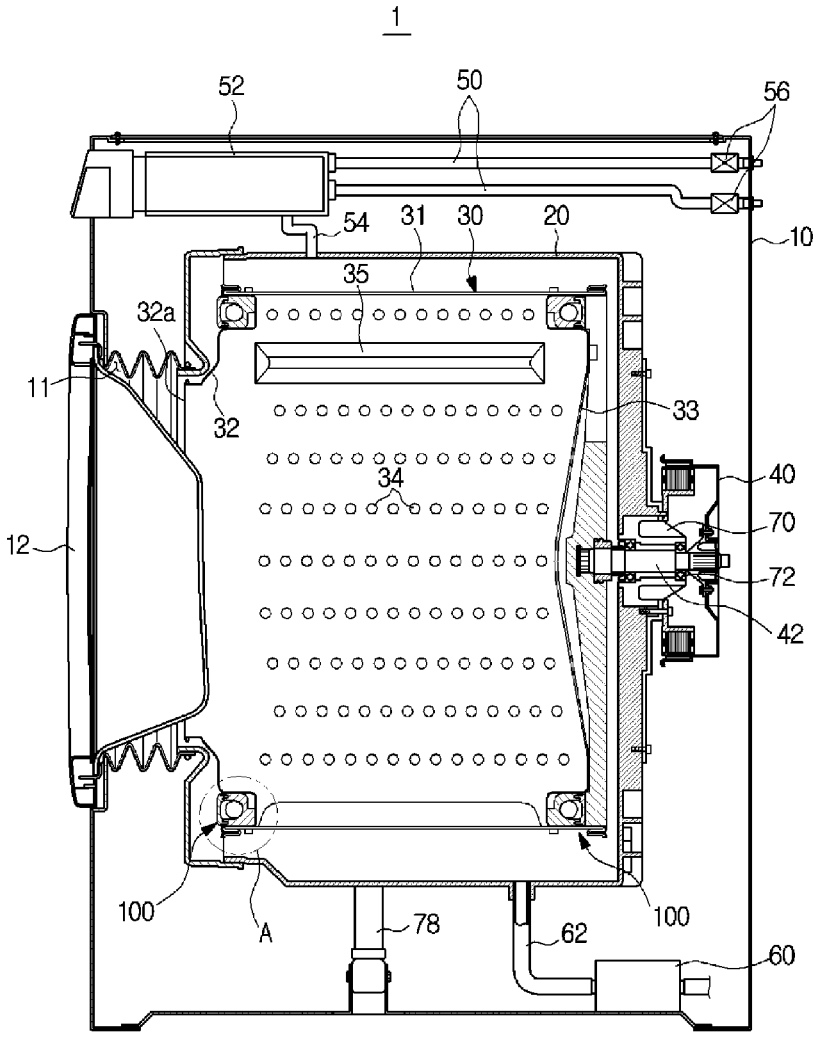

[Fig. 2]
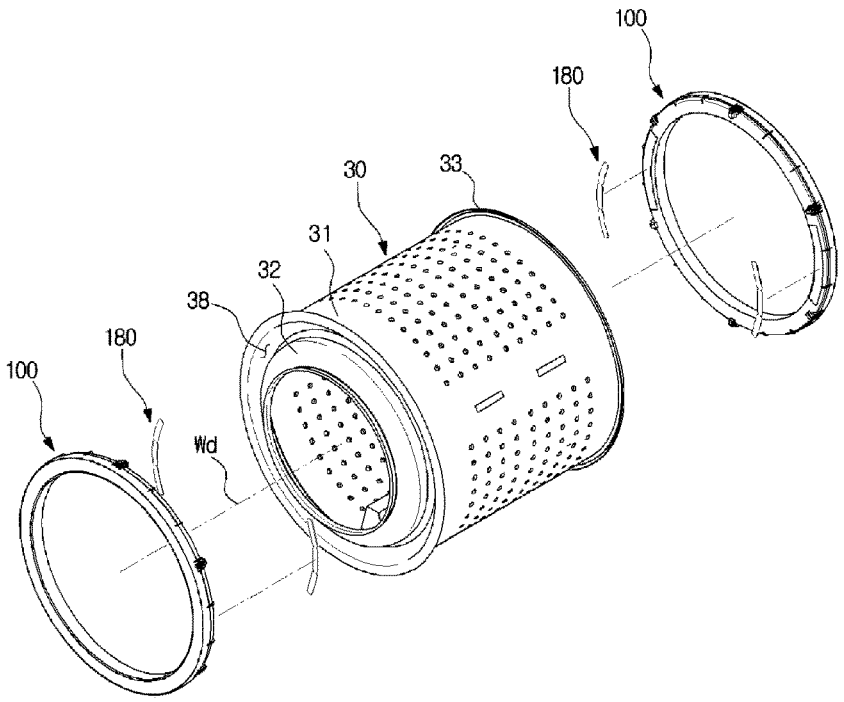
[Fig. 3]
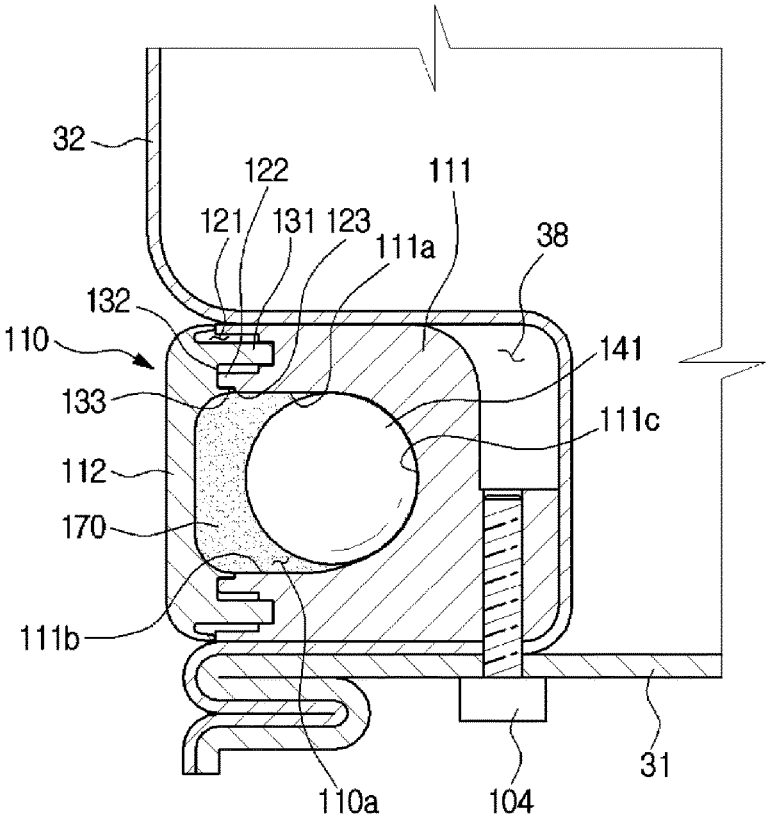

[Fig. 4]
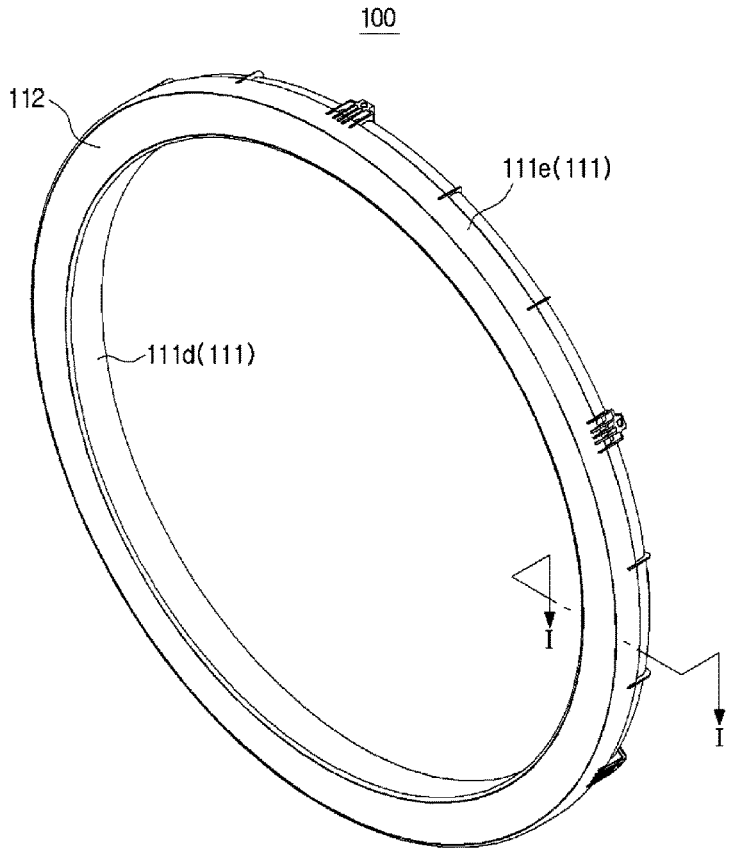
[Fig. 5]
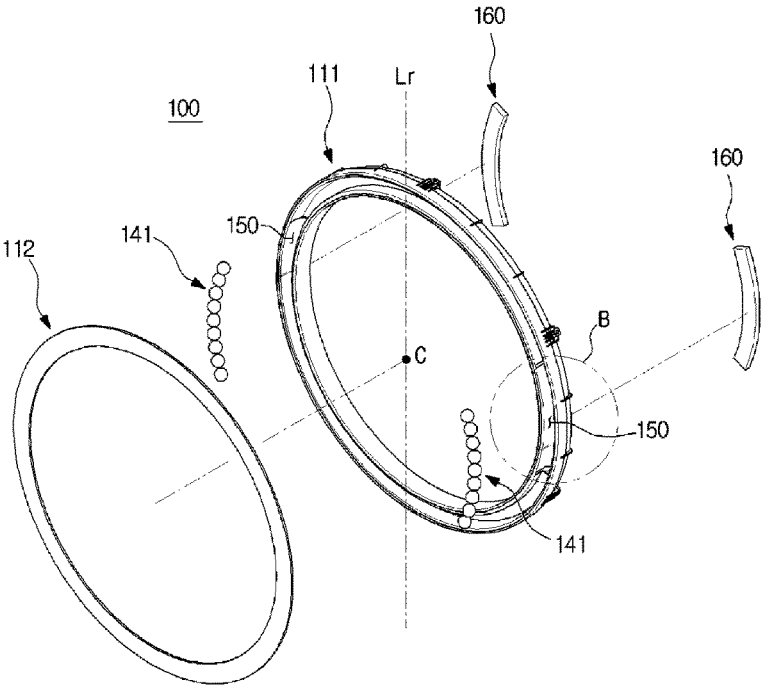

[Fig. 6]
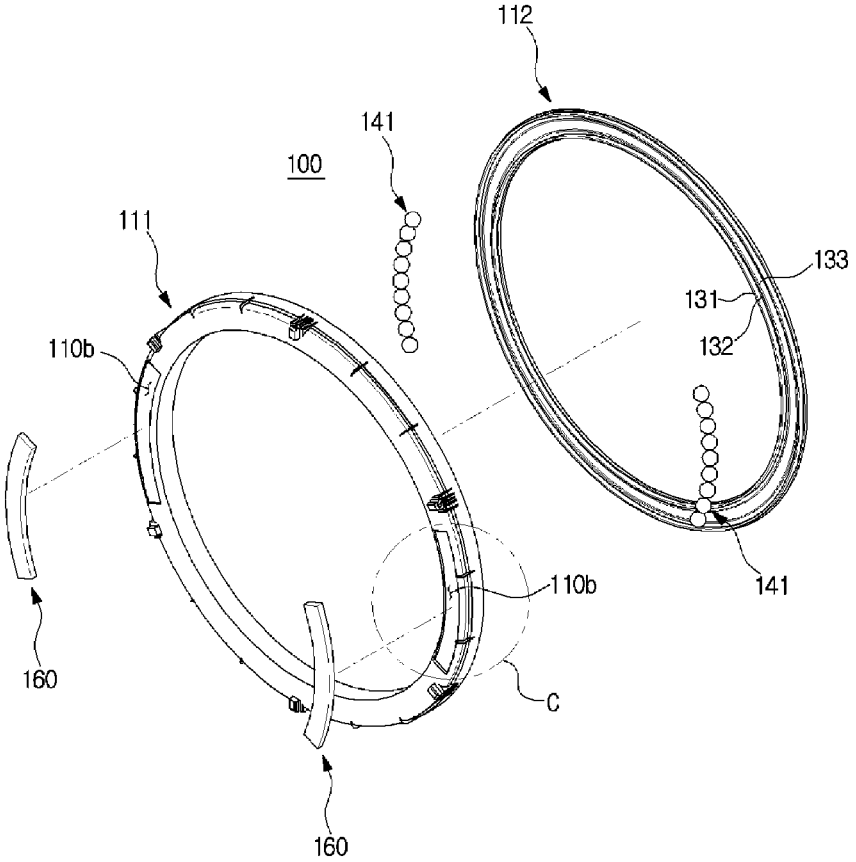

[Fig. 7]
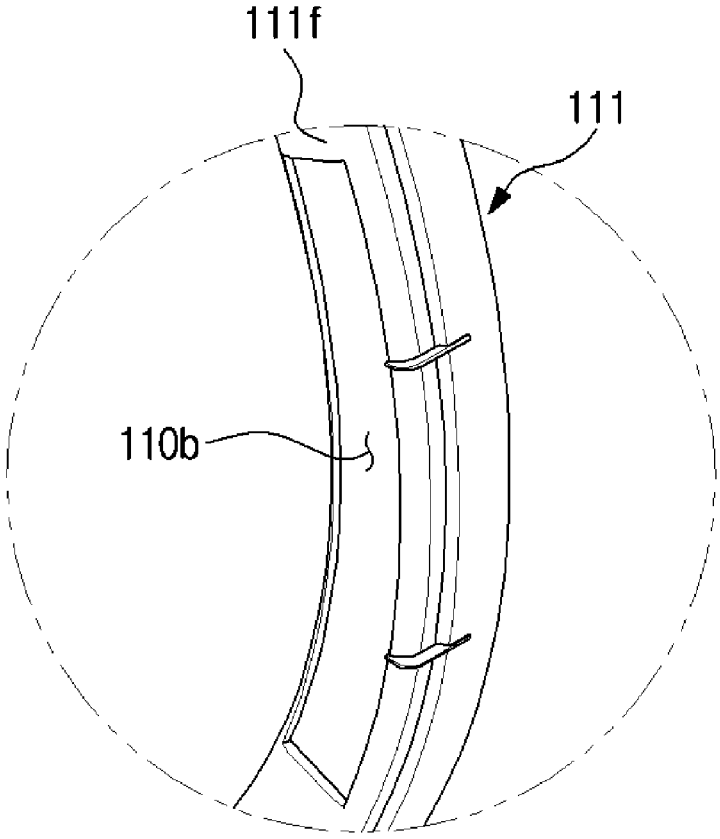

[Fig. 8]
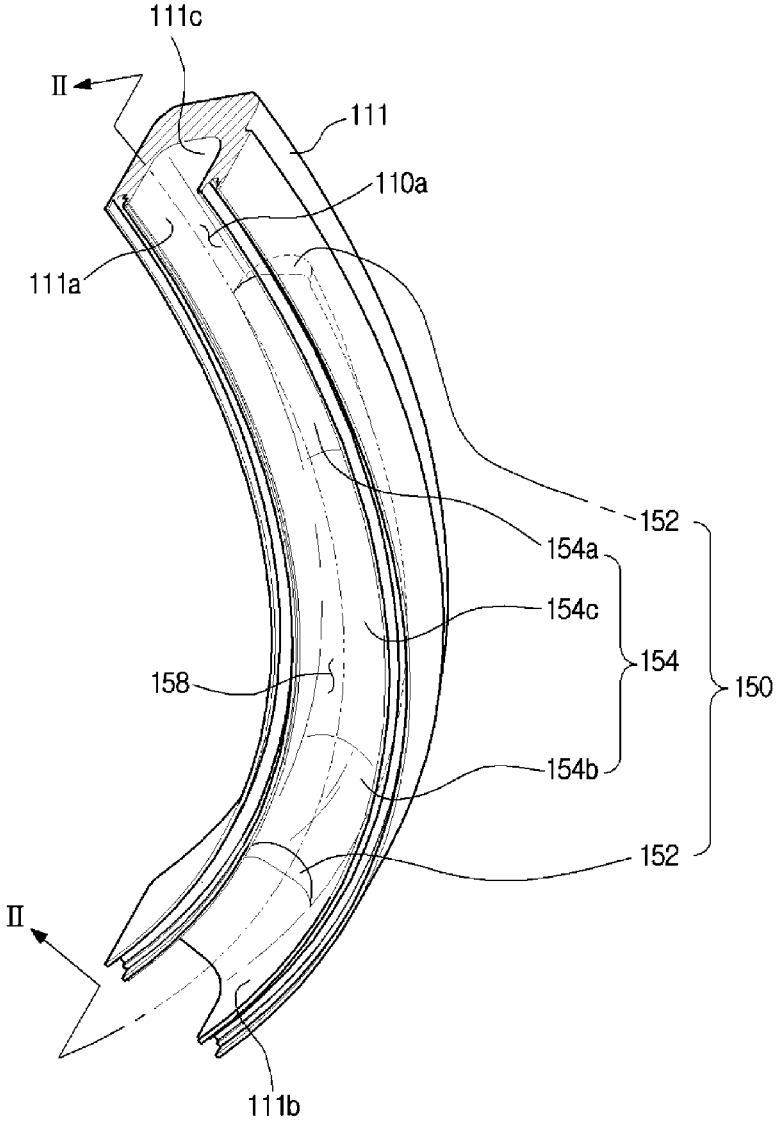

[Fig. 9]
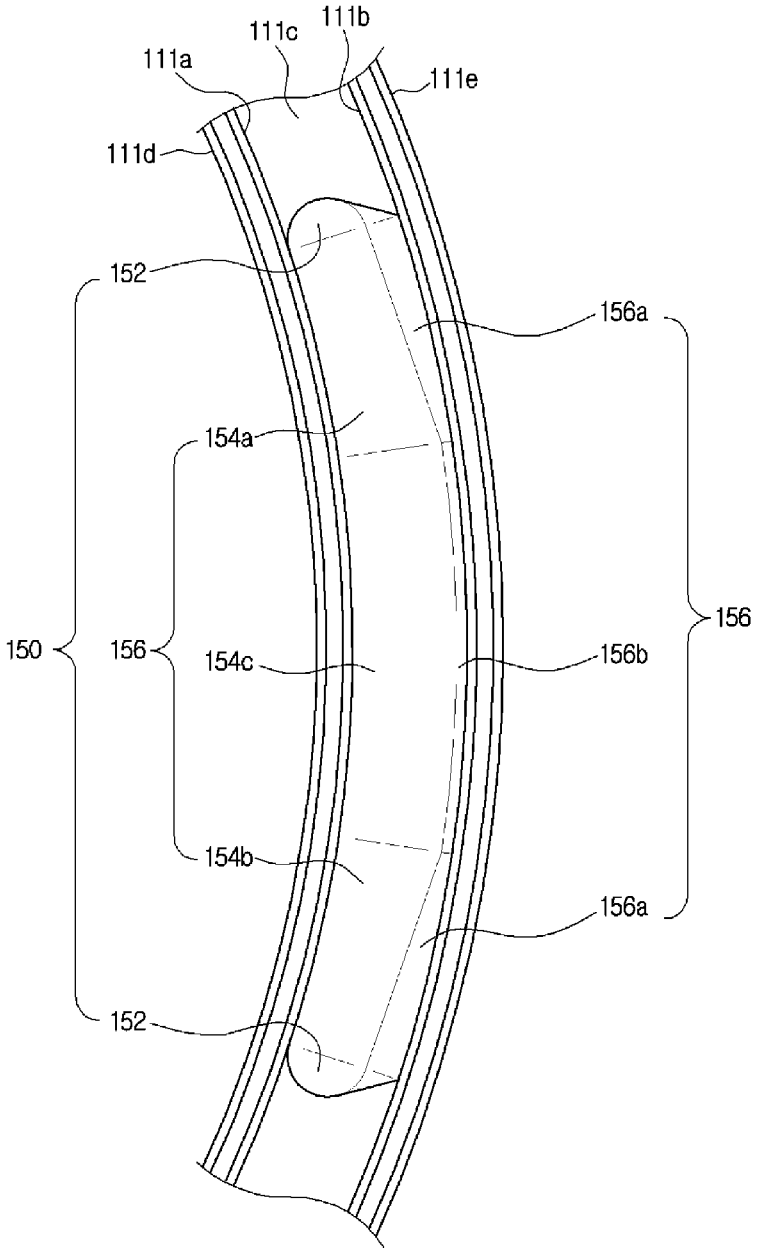

[Fig. 10]
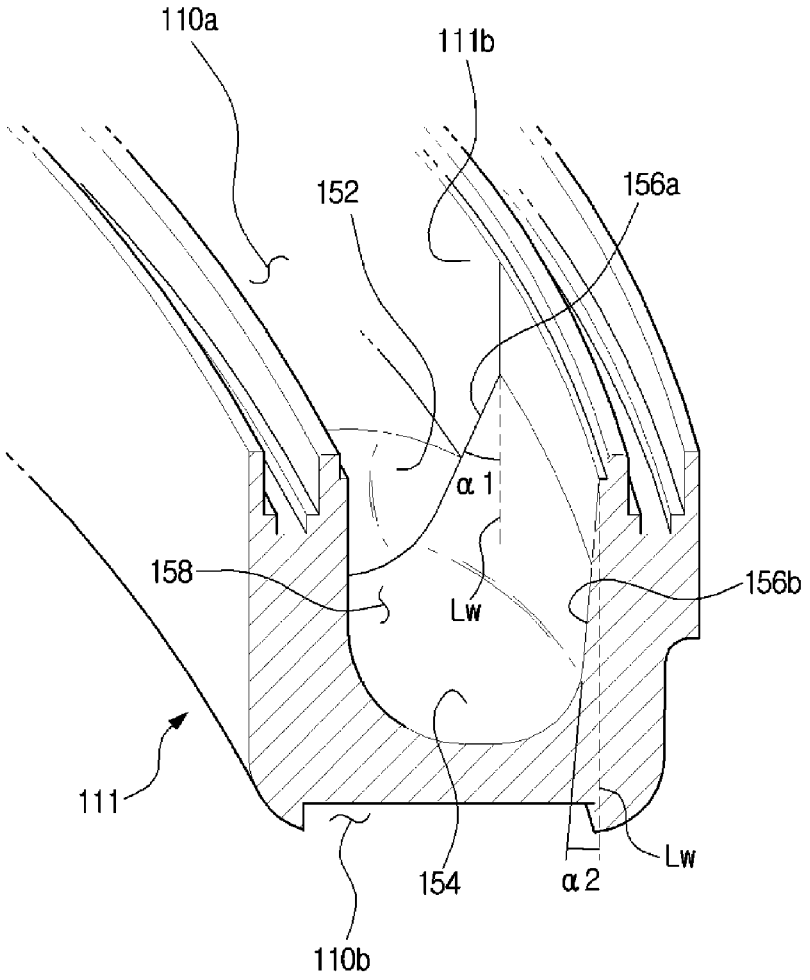

[Fig. 11]
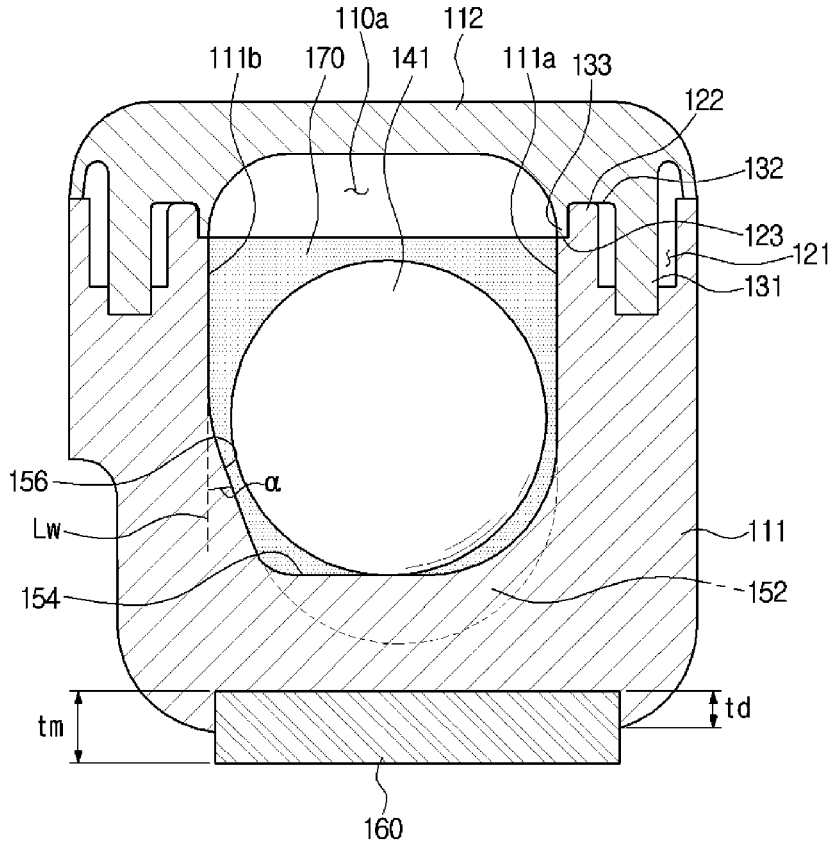
[Fig. 12]
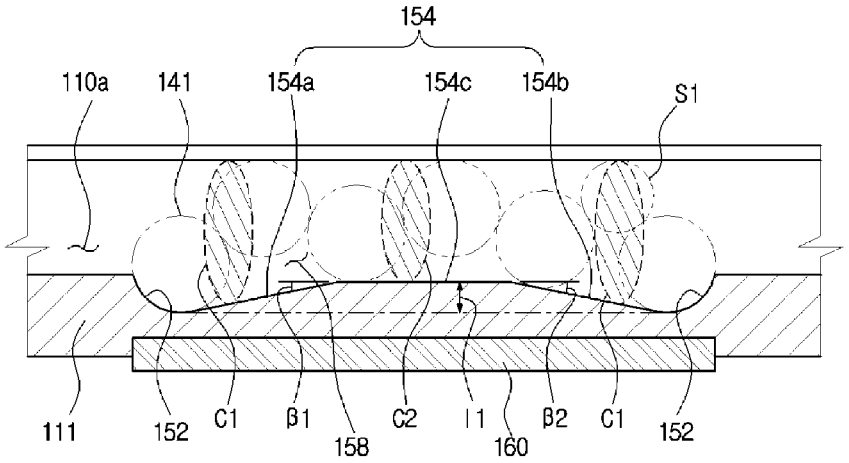

[Fig. 13]
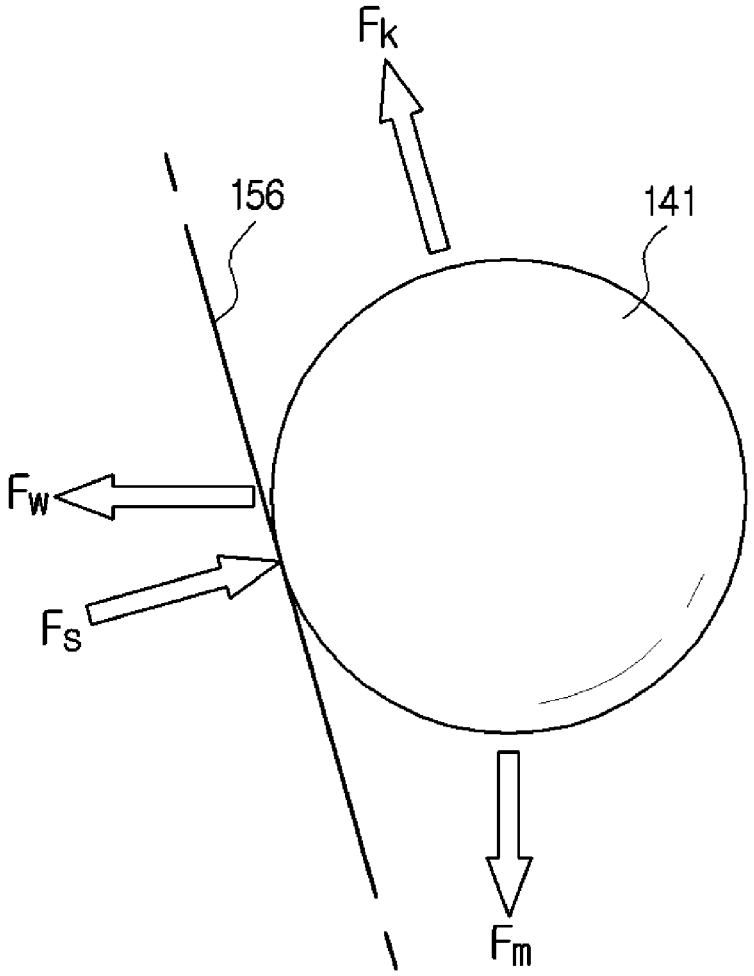

[Fig. 14]
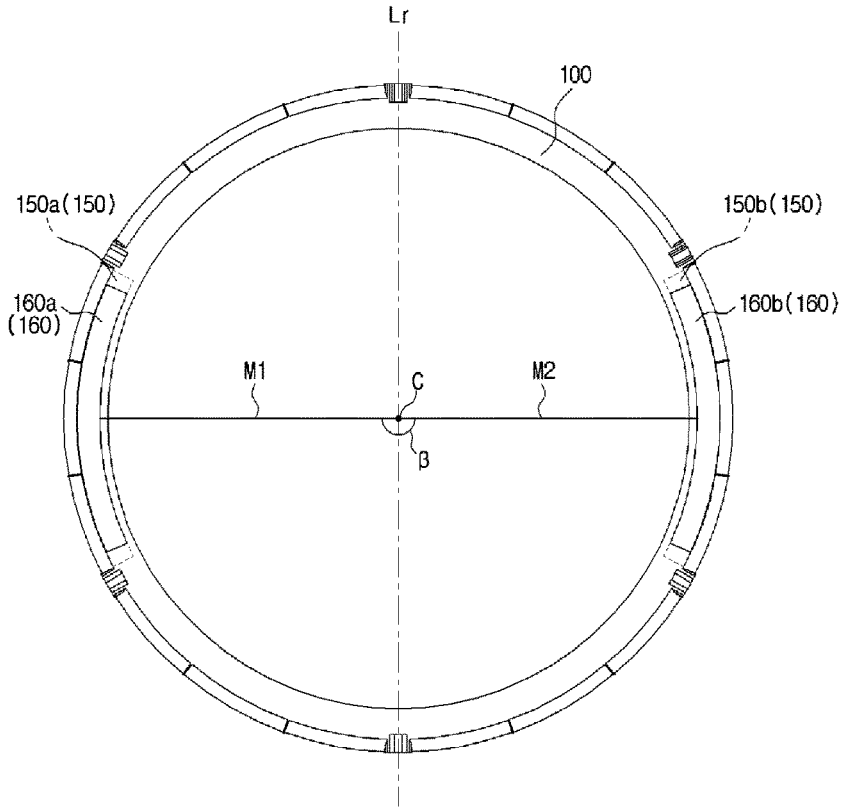
[Fig. 15]
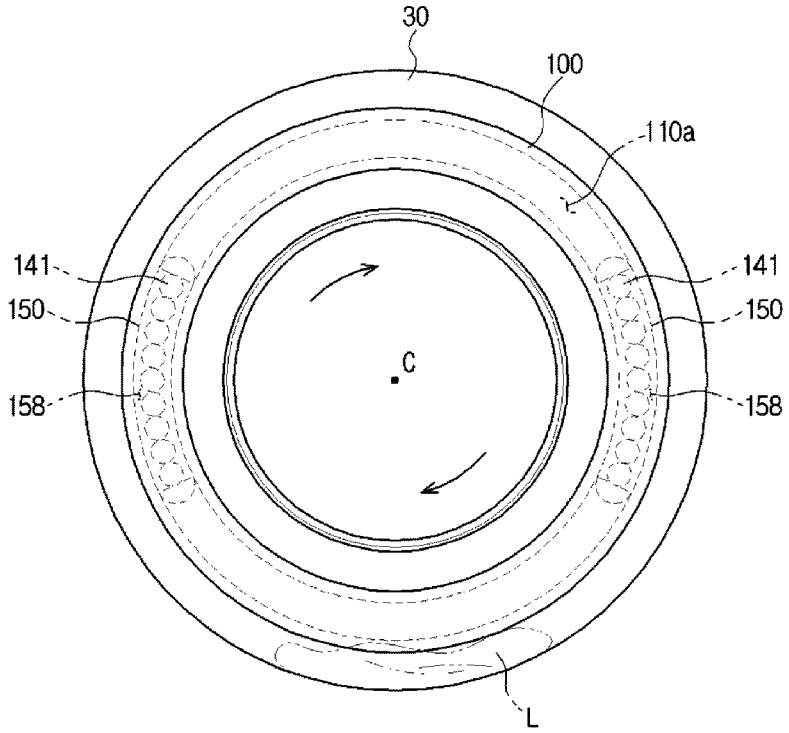

[Fig. 16]
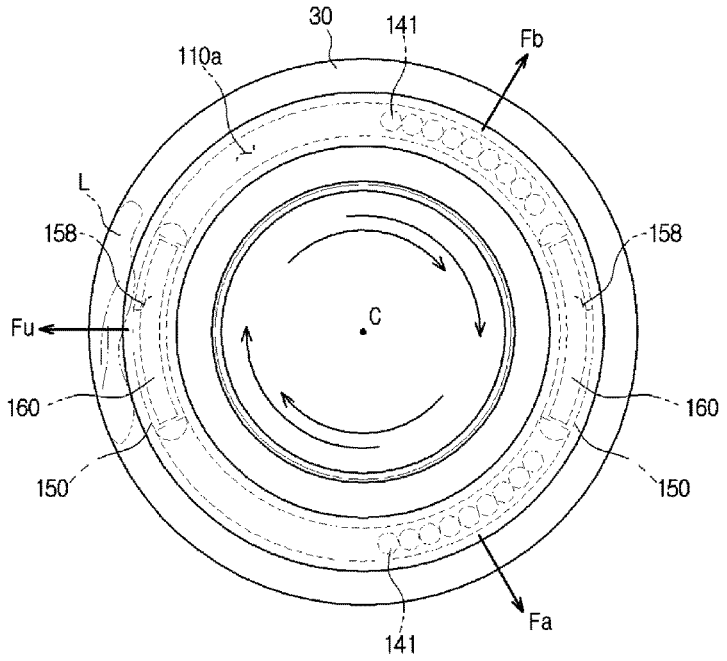
[Fig. 17]
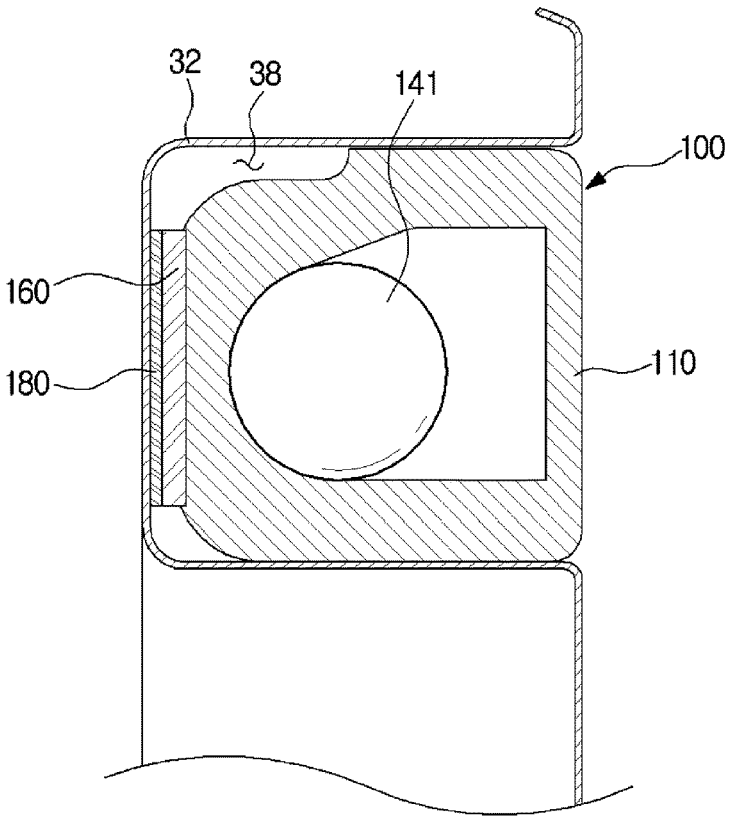

[Fig. 18]
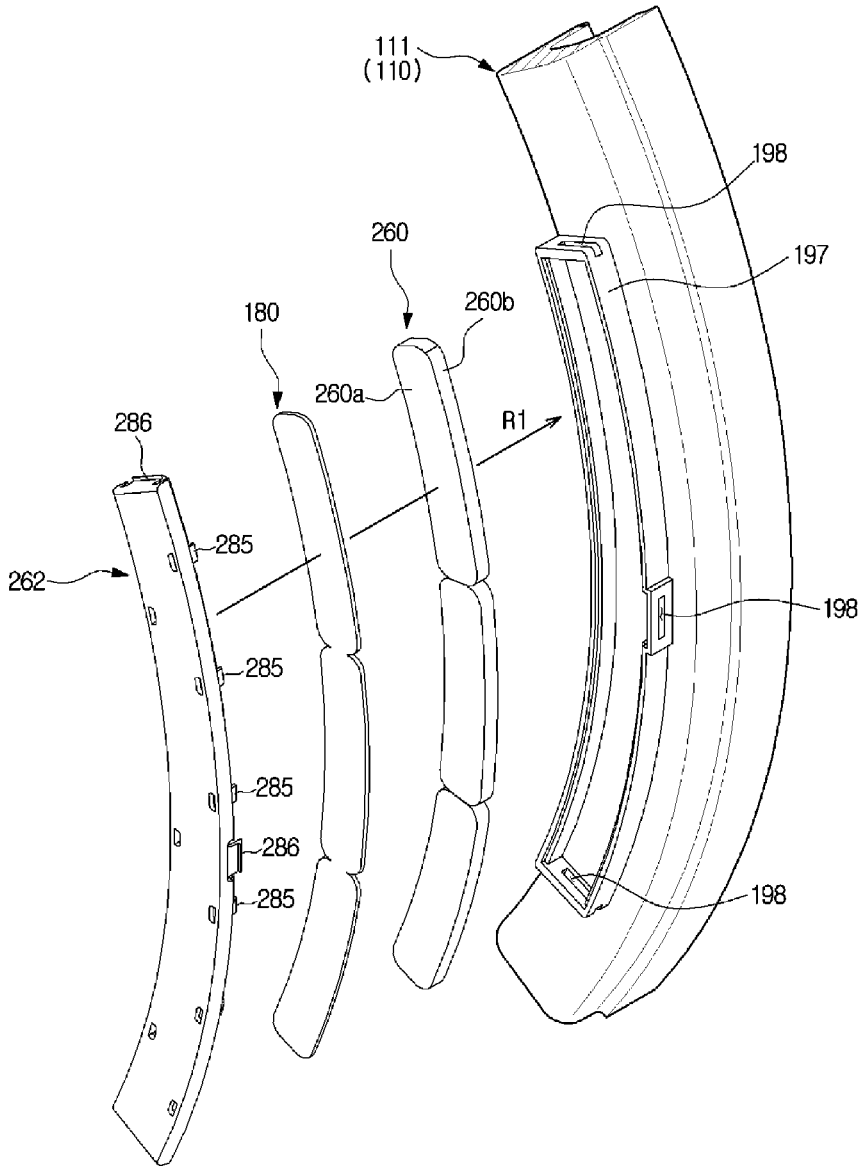

[Fig. 19]
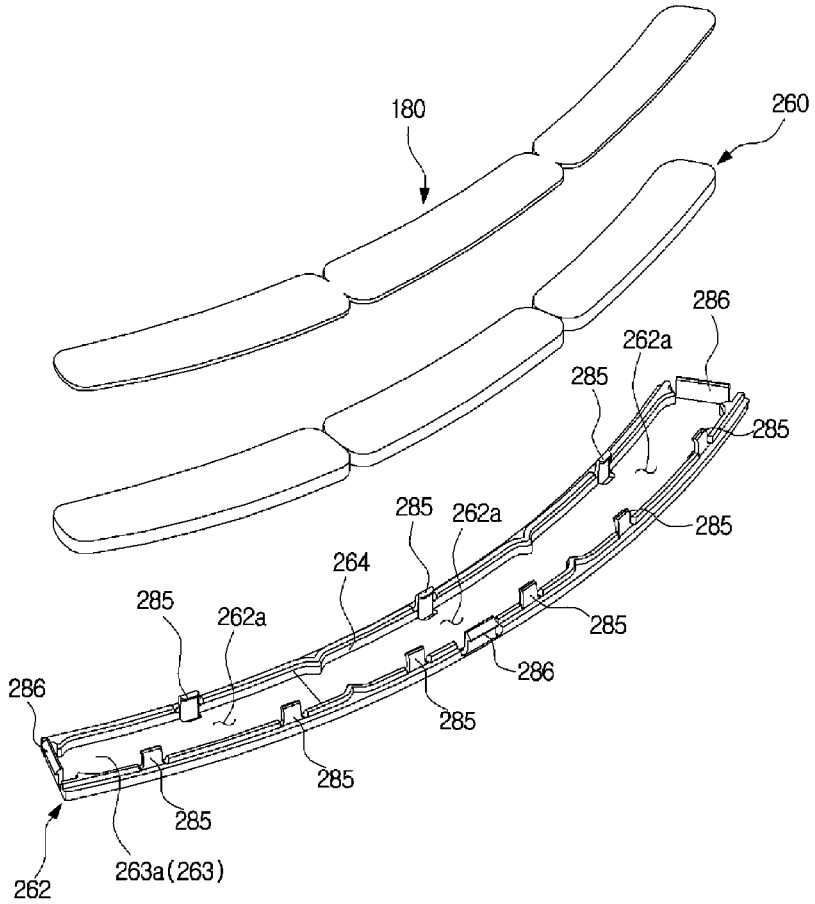

[Fig. 20]
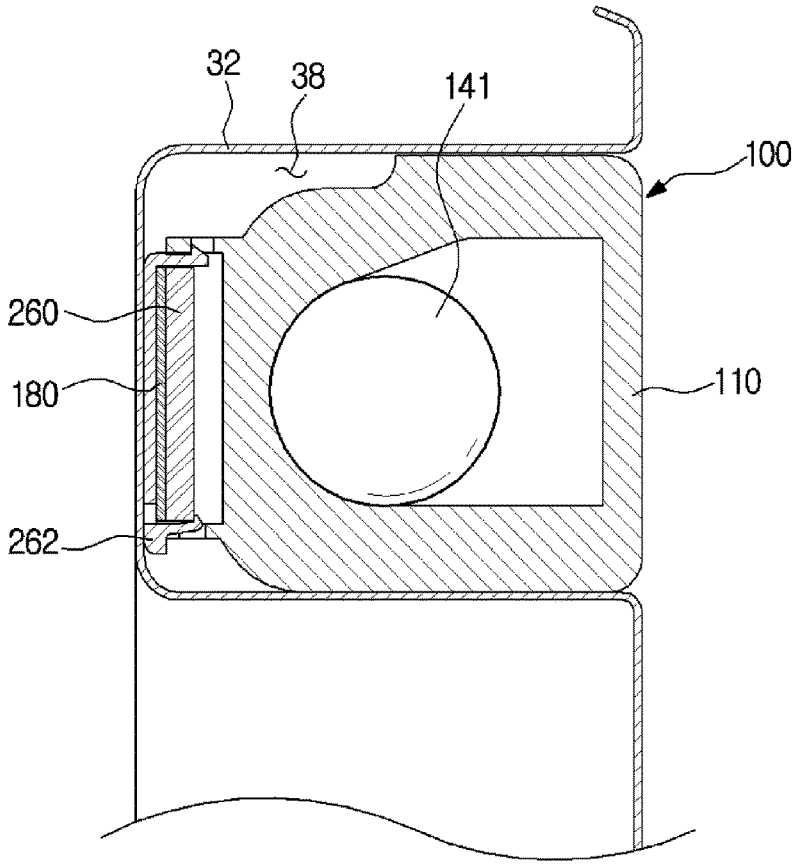
[Fig. 21]
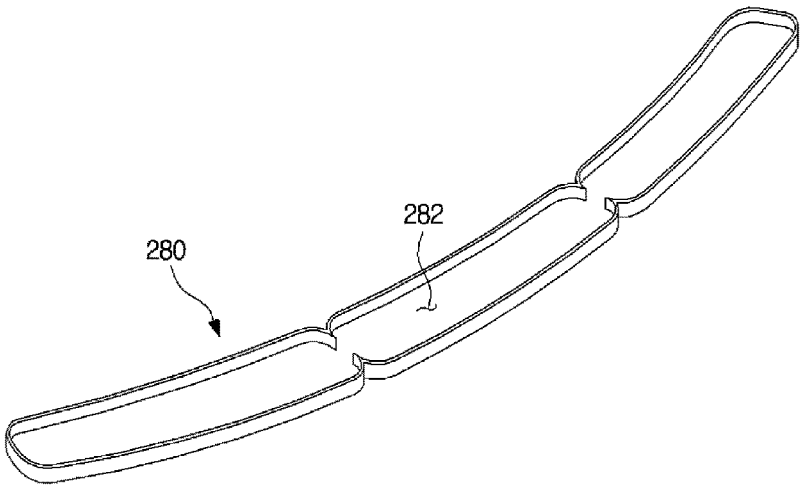

[Fig. 22a]
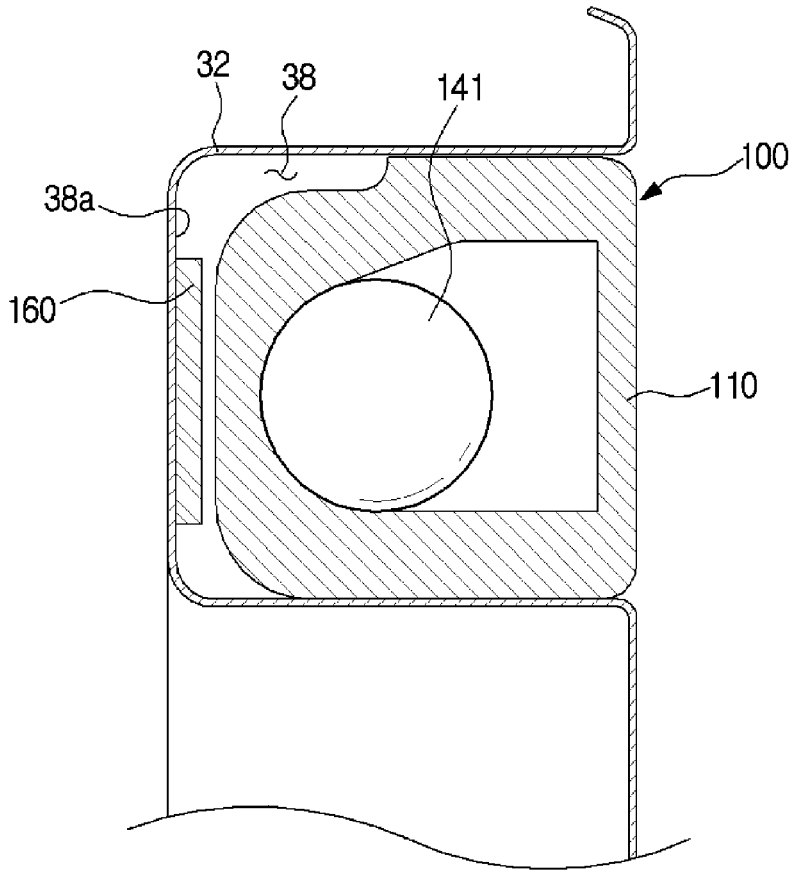

[Fig. 22b]
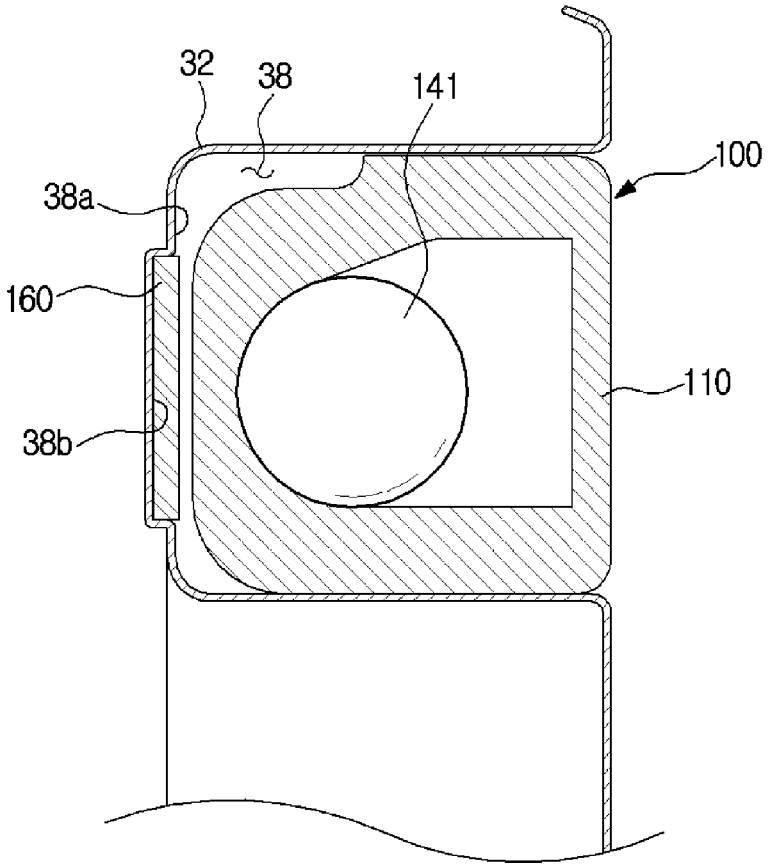

[Fig. 22c]
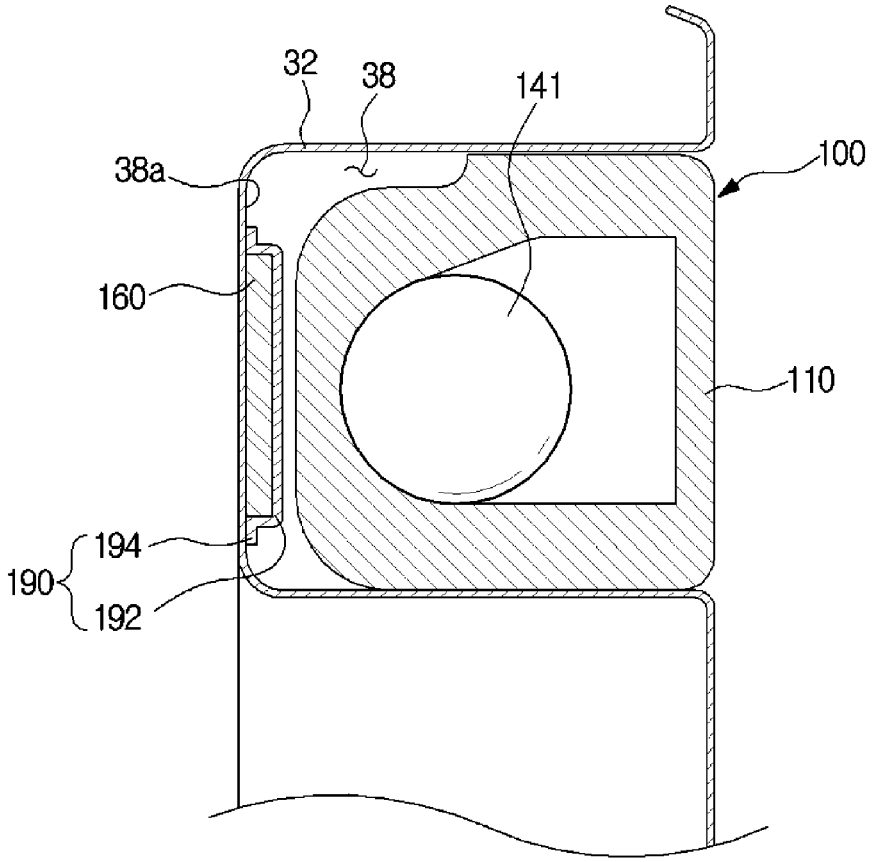

[Fig. 23a]
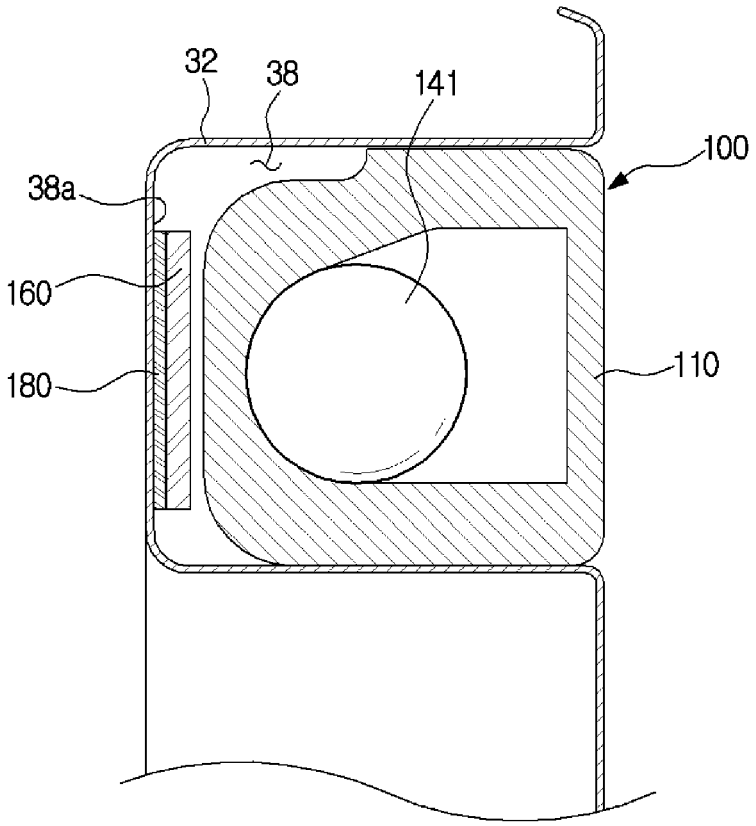

[Fig. 23b]
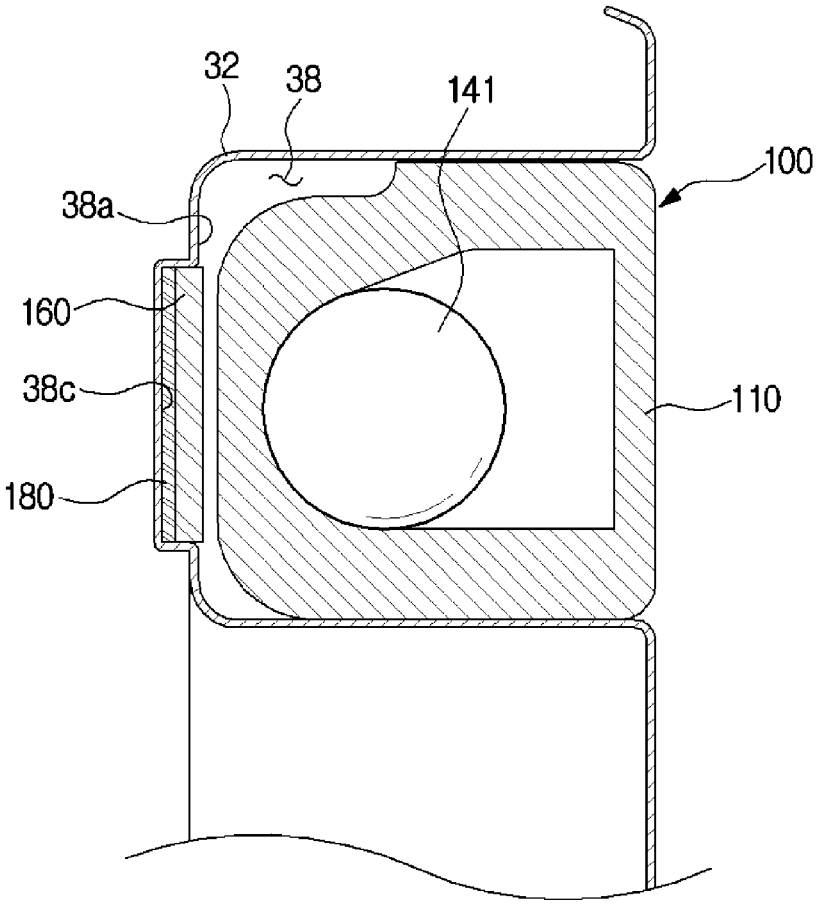

[Fig. 23c]
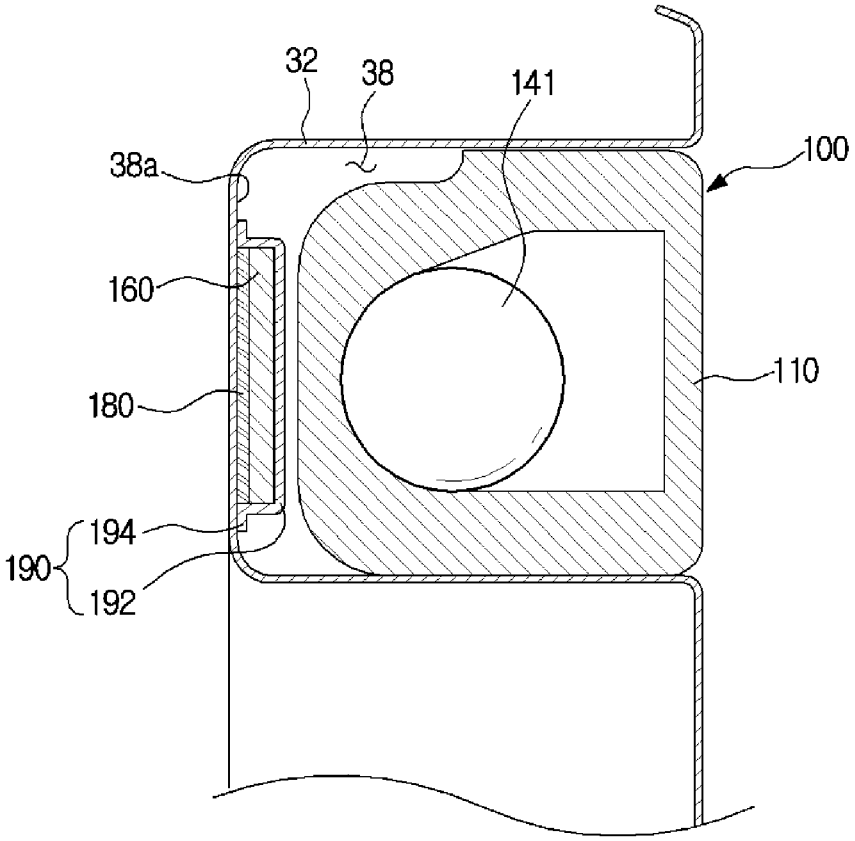

BALANCER OF WASHING MACHINE

CROSS-REFERENCE TO RELATED APPLICATION(S)

The present application claims priority under 35 U.S.C. § 365 to International Patent Application No. PCT/KR2014/009330 filed Oct. 2, 2014, entitled "BALANCER OF WASHING MACHINE", and, through International Patent Application No. PCT/KR2014/009330, to Korean Patent Application No. 10-2013-0118403 filed Oct. 4, 2013 and Korean Patent Application No. 10-2014-0090950 filed Jul. 18, 2014, each of which are incorporated herein by reference into the present disclosure as if fully set forth herein.

TECHNICAL FIELD

Embodiments of the present invention relate to a washing machine with a balancer capable of offsetting an unbalanced load generated while a drum is rotated.

BACKGROUND ART

In general, a washing machine is an apparatus for washing clothes using electric power, and includes a cabinet forming an exterior of the washing machine, a tub storing wash water in the cabinet, a drum installed in the tub to be rotatable, and a motor rotating the drum.

If the drum is rotated by the motor while laundry and wash water are put into the drum, the laundry is rubbed against the drum and the wash water, and thus dirt on the laundry is removed.

When the drum is rotated, if the laundry is not uniformly spread in the drum but is crowded at a certain portion, vibrations and noises are generated due to an eccentric rotation of the drum. In severe cases, components such as the drum and the motor may be damaged.

DISCLOSURE OF INVENTION

Technical Problem

When the drum is rotated, if the laundry is not uniformly spread in the drum but is crowded at a certain portion, vibrations and noises are generated due to an eccentric rotation of the drum. In severe cases, components such as the drum and the motor may be damaged.

Solution to Problem

Therefore, it is an aspect of the present invention to provide a balancer of a washing machine, which has an improved balancing function.

Additional aspects of the invention will be set forth in part in the description which follows and, in part, will be obvious from the description, or may be learned by practice of the invention.

In accordance with one aspect of the present invention, a washing machine includes a cabinet; a drum disposed in the cabinet to be rotatable; a balancer installed at the drum to offset an unbalanced load generated at the drum when the drum is rotated; and at least one magnetic body disposed between the balancer and the drum.

The balancer may include a balancer housing having an annular channel formed therein, at least one mass disposed in the channel to be movable, and at least one magnet provided at one side of the balancer housing to restrict a movement of the mass along the channel when a rotational speed of the drum is in a particular range, and the magnetic body may be disposed between a front surface of the drum and the magnet.

The drum may include a cylindrical part, a front plate disposed at a front portion of the cylindrical part, and a recess formed at the front plate, and the magnetic body may be disposed inside the recess.

The magnetic body may be formed in a shape corresponding to the magnet.

The magnetic body may be formed in a plate shape.

The magnetic body may be formed in a case shape of which one side is opened.

At least two or more magnetic bodies may be disposed to be spaced in a circumferential direction of the balancer housing.

The balancer may include a magnet case configured to receive the magnet, and the magnetic body may be received in the magnet case.

The magnetic body may be disposed between the magnet and the magnet case.

A thickness of the magnetic body may be 0.5 mm or more and 3 mm or less.

In accordance with another aspect of the present invention, a balancer of a washing machine, which offsets an unbalanced load generated at a drum of the washing machine, includes a balancer housing installed at at least one of a front surface and a rear surface of the drum and having a channel configured to extend in a circumferential direction of the drum; a plurality of masses disposed to be movable along the channel; at least one magnet disposed at a rear side of the balancer housing to restrict the plurality of masses when an RPM (revolutions per minute) of the drum is in a particular range; and at least one magnetic body disposed at a rear side of the magnet to have an influence on a magnetic force of the magnet, and to concentrate the magnetic force of the magnet to an inner side of the balancer housing.

The balancer according may further include a magnet case configured to receive the magnet and the magnetic body and coupled to a rear surface of the balancer housing.

The magnetic body may be formed in a plate shape.

The magnetic body may include a receiving part configured to receive the magnet.

Advantageous Effects of Invention

According to the embodiments of the present invention, since the magnetic force of the magnet provided at the balancer is strengthened, and thus the masses are reliably restricted by the magnet, the balancer can effectively offset the unbalanced load acting on the drum, and thus can stabilize the rotation of the drum.

BRIEF DESCRIPTION OF DRAWINGS

These and/or other aspects of the invention will become apparent and more readily appreciated from the following description of the embodiments, taken in conjunction with the accompanying drawings of which:

FIG. 1 is a view illustrating a configuration of a washing machine in accordance with one embodiment of the present invention;

FIG. 2 is an exploded perspective view illustrating a balancer in accordance with one embodiment of the present invention;

FIG. 3 is an enlarged view illustrating an 'A' portion of FIG. 1;

FIG. 4 is a perspective view illustrating the balancer in accordance with one embodiment of the present invention;

FIG. 5 is an exploded perspective view illustrating a state in which the balancer of FIG. 4 is disassembled;

FIG. 6 is an exploded perspective view when FIG. 5 is seen at another angle;

FIG. 7 is an enlarged view illustrating a 'C' portion of FIG. 6;

FIG. 8 is an enlarged view illustrating a 'B' portion of FIG. 5;

FIG. 9 is a front view of FIG. 8;

FIG. 10 is an enlarged view illustrating an inclined side wall;

FIG. 11 is a cross-sectional view taken along line I-I of FIG. 4;

FIG. 12 is a cross-sectional view taken along line II-II of FIG. 8;

FIG. 13 is a view illustrating a relationship among a centrifugal force, a magnetic force, and a supporting force of the inclined side wall;

FIG. 14 is a view illustrating a structure in which a magnet is disposed on a balancer housing;

FIGS. 15 and 16 are views respectively illustrating an operation principle of the balancer in accordance with one embodiment of the present invention;

FIG. 17 is a cross-sectional view illustrating a state in which the balancer in accordance with one embodiment of the present invention is installed at a drum;

FIG. 18 is an exploded perspective view illustrating a coupling structure between a magnet and a balancer housing of a balancer in accordance with another embodiment of the present invention;

FIG. 19 is an exploded perspective view illustrating a magnet case, a magnet, and a magnetic body extracted from FIG. 18;

FIG. 20 is a cross-sectional view illustrating a state in which the balancer in accordance with another embodiment of the present invention is installed at a drum;

FIG. 21 is a view illustrating another embodiment of the magnetic body;

FIGS. 22A to 22C are views illustrating a state in which a balancer in accordance with still another embodiment of the present invention is installed at a drum; and FIGS. 23A to 23C are views illustrating a state in which a balancer in accordance with yet another embodiment of the present invention is installed at a drum.

BEST MODE FOR CARRYING OUT THE INVENTION

Hereinafter, exemplary embodiments of the present invention in accordance with embodiments of the present invention will be described in detail with reference to the accompanying drawings.

FIG. 1 is a view illustrating a configuration of a washing machine in accordance with one embodiment of the present invention.

As illustrated in FIG. 1, the washing machine 1 includes a cabinet 10 forming an exterior thereof, a tub 20 disposed in the cabinet 10, a drum 30 installed in the tub 20 to be rotatable, and a motor 40 configured to drive the drum 30.

A laundry port 11 is formed at a front surface of the cabinet 10 to put laundry into the drum 30. The laundry port 11 is opened and closed by a door 12 installed at the front surface of the cabinet 10.

A water pipe 50 which supplies wash water into the tub 20 is installed above the tub 20. One side of the water pipe 50 is connected with a water feed valve 56, and the other side thereof is connected with a detergent supply unit 52.

The detergent supply unit 52 is connected to the tub 20 through a connecting pipe 54. Water supplied through the water pipe 50 is supplied into the tub 20 via the detergent supply unit 52 together with a detergent.

A drain pump 60 and a drain pipe 62 which discharge water in the tub 20 to an outer side of the cabinet 10 are installed under the tub 20.

The drum 30 includes a cylindrical part 31, a front plate 32 disposed at a front portion of the cylindrical part 31, and a rear plate 33 disposed at a rear portion of the cylindrical part 31. An opening 32*a* for entry and exist of the laundry is formed at the front plate 32, and a driving shaft 42 configured to transmit a power of the motor 40 is connected to the rear plate 33.

A plurality of through-holes 34 for distribution of the wash water are formed at a circumference of the drum 30, and a plurality of lifters 35 are installed at an inner circumferential surface of the drum 30 to raise and drop the laundry when the drum 30 is rotated.

The driving shaft 42 is disposed between the drum 30 and the motor 40. One end of the driving shaft 42 is connected to the rear plate 33 of the drum 30, and the other end thereof extends to an outer side of a rear wall of the tub 20. When the motor 40 drives the driving shaft 42, the drum 30 connected with the driving shaft 42 is rotated about the driving shaft 42.

A bearing housing 70 is installed at the rear wall of the tub 20 to rotatably support the driving shaft 42. The bearing housing 70 may be formed of an aluminum alloy, and may be inserted into the rear wall of the tub 20 when injection-molding the tub 20. Bearings 72 are installed between the bearing housing 70 and the driving shaft 42 so that the driving shaft 42 is smoothly rotated.

The tub 20 is supported by a damper 78. The damper 78 connects an inner lower surface of the cabinet 10 with an outer surface of the tub 20.

In a washing stroke, the motor 40 forwardly and reversely rotates the drum 30 at a low speed, and thus while the laundry in the drum 30 is repeatedly raised and dropped, dirt is removed from the laundry.

In a spin-drying stroke, when the motor 40 rotates the drum 30 at a high speed in one direction, the water is separated from the laundry by a centrifugal force applied to the laundry.

In a spin-drying process, when the drum 30 is rotated, if the laundry is not uniformly spread in the drum 30 but is concentrated at a certain portion, the drum 30 is unstably rotated, and thus vibrations and noises are generated.

Therefore, the washing machine 1 has a balancer 100 to stabilize a rotation of the drum 30.

FIG. 2 is an exploded perspective view illustrating a balancer in accordance with one embodiment of the present invention, FIG. 3 is an enlarged view illustrating an 'A' portion of FIG. 1, FIG. 4 is a perspective view illustrating the balancer in accordance with one embodiment of the present invention, FIG. 5 is an exploded perspective view illustrating a state in which the balancer of FIG. 4 is disassembled, FIG. 6 is an exploded perspective view when FIG. 5 is seen at another angle, FIG. 7 is an enlarged view illustrating a 'C' portion of FIG. 6, FIG. 8 is an enlarged view illustrating a 'B' portion of FIG. 5, FIG. 9 is a front view of FIG. 8, and FIG. 10 is an enlarged view illustrating an inclined side wall. FIG. 11 is a cross-sectional view taken along line I-I of FIG. 4, and FIG. 12 is a cross-sectional view taken along line II-II of FIG. 8.

The balancer 100 may be installed at at least one of the front plate 32 and the rear plate 33 of the drum 30. Since the balancers 100 installed at the front plate 32 and the rear plate 33 are the same, the balancer 100 installed at the front plate 32 will be mainly described.

As illustrated in FIGS. 1 to 12, the balancer 100 includes a balancer housing 110 having an annular channel 110*a*, and a plurality of masses 141 disposed in the annular channel 110*a* to be moved along the annular channel 110*a* and thus to perform a balancing function of the drum 30.

An annular recess 38 of which a front portion is opened is formed at the front plate 32 of the drum 30, and the balancer housing 110 is received in the recess 38. The balancer housing 110 may be coupled to the drum 30 by a fixing member 104 to be firmly coupled to the drum 30.

The balancer housing 110 includes an annular first housing 111 of which one side is opened, and a second housing 112 which covers an opened portion of the first housing 111. An inner surface of the first housing 111 and an inner surface of the second housing 112 define the annular channel 110*a*. The first housing 111 and the second housing 112 may be fabricated by an injection molding using a plastic material such as polypropylene (PP) and acrylonitrile butadiene styrene (ABS), and may be coupled with each other in a thermal bonding manner. Hereinafter, a front surface of the balancer housing 110 is defined as a surface which is exposed to a front side thereof when the balancer housing 110 is coupled to the drum 30, a rear surface of the balancer housing 110 is defined as a surface opposed to the front surface of the balancer housing 110, which faces the front plate 32 of the drum 30 when the balancer housing 110 is coupled to the drum 30, and a side surface of the balancer housing 110 is defined as a surface which connects the front surface of the balancer housing 110 with the rear surface thereof.

In the first housing 111, a first coupling groove 121 is formed at both sides of the channel 110*a*, and the second housing 112 has a first coupling protrusion 131 coupled into the first coupling groove 121. A second coupling protrusion 122 is formed between the first coupling groove 121 of the first housing 111 and the channel 110*a*. The second coupling protrusion 122 of the first housing 111 is coupled into a second coupling groove 132 formed at an inner side of the first coupling protrusion 131 of the second housing 112. A third coupling groove 123 is formed at an inner surface of the second coupling protrusion 122 adjacent to the channel 110*a*, and the second housing 112 has a third coupling protrusion 133 coupled to the third coupling groove 123. Due to such a coupling structure, the first housing 111 and the second housing 112 may be firmly coupled to each other, and when a fluid such as oil is received in the channel 110*a*, a leakage of the fluid may be prevented.

The first housing 111 includes first and second inner surfaces 111*a* and 111*b* disposed to face each other, and a third inner surface 111*c* configured to connect the first inner surface 111*a* with the second inner surface 111*b*. The first inner surface 111*a* is a surface corresponding to an inner surface 111*d* of the first housing 111, and the second inner surface 111*b* is a surface corresponding to an outer surface 111*e* of the first housing 111.

A groove 150 which settles and temporarily restricts the plurality of masses 141 is formed at at least one of the first inner surface 111*a*, the second inner surface 111*b*, and the third inner surface 111*c*. FIGS. 8 and 9 illustrates a state in which the groove 150 is formed over the first inner surface 111*a* and the third inner surface 111*c*, but the present invention is not limited thereto. The groove 150 may be formed at only one of the first inner surface 111*a*, the second inner surface 111*b*, and the third inner surface 111*c*, may be formed over the first inner surface 111*a* and the third inner surface 111*c*, or may be formed over all of the first inner surface 111*a*, the second inner surface 111*b*, and the third inner surface 111*c*.

In a state in which the masses 141 are settled and received in the groove 150, to prevent an unbalanced load from being generated at the drum 30 by the masses 141, the groove 150 may be disposed at positions which are symmetrical with each other with respect to an imaginary line Lr passing a rotational center of the drum 30 and vertical to the ground.

The groove 150 is formed long in a circumferential direction of the balancer housing 110 to receive at least two or more masses 141, and includes a first support portion 152 which supports the masses 141 approximately in the circumferential direction and a radial direction of the balancer housing 110, a second support portion 154 provided between the first support portions 152 to support the masses 141 approximately in the radial direction of the balancer housing 110, inclined surfaces 154*a* and 154*b* formed to be inclined toward an inner side of the channel 110*a*, and at least one flat surface 154*c* provided between the inclined surfaces 154*a* and 154*b*.

The first support portion 152 is provided at both ends of the groove 150 to have a step shape and thus to prevent the masses 141 from being separated from the groove 150 when an RPM (revolutions per minute) of the drum 30 is in a particular range.

The second support portion 154 is provided to protrude toward the inner side of the channel 110*a*, and the inclined surfaces 154*a* and 154*b* and the flat surface 154*c* are provided at the second support portion 154. The inclined surfaces 154*a* and 154*b* includes a first inclined surface 154*a* and a second inclined surface 154*b* which are disposed to have the flat surface 154*c* therebetween. Both ends of the first and second inclined surfaces 154*a* and 154*b* are respectively connected with the first support portion 152 and the flat surface 154*c*. A first inclined angle β1 formed by the flat surface 154*c* and the first inclined surface 154*a* and a second inclined angle β2 formed by the flat surface 154*c* and the second inclined surface 154*b* may be different from each other. A length l1 that the second support portion 154 protrudes toward the inner side of the channel may be 1 mm or more and 3 mm or less.

The channel 110*a* at a portion in which the groove 150 is formed includes a cross section increasing portion 158 in which a cross section thereof is increased. The cross section increasing portion 158 is a space which is formed at the channel 110*a* by the groove 150, and may be formed in a shape corresponding to at least part of the mass 141, formed long in the circumferential direction of the balancer housing 110 to receive at least two or more masses 141, like the groove 150, and disposed at the positions which are symmetrical with each other with respect to the imaginary line Lr passing the rotational center of the drum 30.

Due to the first inclined surface 154*a*, the second inclined surface 154*b*, and the flat surface 154*c* provided at the second support portion 154, cross sectional areas C1 of both ends of the cross section increasing portion 158 are formed to be greater than a cross sectional area C2 between the both ends of the cross section increasing portion 158.

Since the second support portion 154 is provided to protrude toward the inner side of the channel 110*a*, a margin space S1 is formed between the masses 141 received in the groove 150 or the cross section increasing portion 158. Therefore, when the RPM of the drum 30 deviates from the particular range, the masses 141 may be not fixed in the groove 150, may be actively separated from the groove 150, and may perform the balancing function of the drum 30.

A magnet receiving groove 110*b* in which a magnet 160 is received and coupled is provided at a rear surface 111*f* of the first housing 111 corresponding to an inner surface of the first housing 111, in which the groove 150 is formed. The magnet receiving groove 110*b* may be formed in a shape corresponding to the magnet 160 to couple the magnet 160 therein. A depth td of the magnet receiving groove 110*b* may be formed to be the same as or smaller than a thickness tm of the magnet 160.

The magnet 160 is formed in an arc shape, and coupled into the magnet receiving groove 110*b* to restrict the masses 141, such that at least one mass 141 received in the groove 150 is not separated from the groove 150.

The magnet 160 may be fixed into the magnet receiving groove 110*b* through an adhesive material (not shown). A worker may coat the adhesive material in the magnet receiving groove 110*b*, and then may insert and fix the magnet 160 in the magnet receiving groove 110*b*.

A coupling position of the magnet 160 is not limited to the rear surface of the balancer housing 110. The magnet 160 may be coupled to the front surface of the balancer housing 110, or the side surface of the balancer housing 110 which connects the front surface of the balancer housing 110 with the rear surface thereof.

The magnet 160 restricts the masses 141 through a magnetic force, and an intensity of the magnetic force of the magnet 160 is determined according to the RPM of the drum 30 at a moment when the masses 141 are separated from the groove 150. For example, in order for the RPM of the drum 30 at the moment when the masses 141 are separated from the groove 150 to be 200 rpm, the intensity of the magnetic force of the magnet 160 may be controlled to restrict the masses 141 when the RPM of the drum 30 is 0 to 200 rpm, such that at least one mass 141 received in the groove 150 is not separated from the groove 150, and also controlled so that the mass 141 is separated from the groove 150 when the RPM of the drum 30 exceeds 200 rpm. The intensity of the magnetic force of the magnet 160 may be controlled by a size of the magnet 160, the number of magnets 160, a magnetization manner of the magnet 160, or the like.

An inclined side wall 156 is provided at the second inner surface 111*b* corresponding to the first inner surface 111*a*.

The inclined side wall 156 is formed as at least part of the second inner surface 111*b* connected with the groove 150, provided to form an inclined angle α with respect to an imaginary line Lw parallel with a rotational axis Wd of the drum 30, and thus supports the masses 141 received in the groove 150 when the drum 30 is rotated.

As illustrated in FIG. 13, the inclined side wall 156 generates a supporting force Fs supporting the mass 141 in a direction against a centrifugal force Fw applied to the mass 141 when the drum 30 is rotated.

The centrifugal force Fw applied to the mass 141 when the drum 30 is rotated is offset by the supporting force Fs applied to the mass 141 by the inclined side wall 156. Therefore, a magnetic force Fm generated from the magnet 160 coupled in the rear surface of the balancer housing 110 may offset only a remaining force of the centrifugal force Fw of the mass 141, which is offset by the supporting force Fs applied to the mass 141 by the inclined side wall 156, i.e., a force Fk generated along the inclined side wall 156, and thus may restrict a movement of the mass 141 when the RPM of the drum 30 is in the particular range.

As described above, since the inclined side wall 156 is formed at the second inner surface 111*b* corresponding to the first inner surface 111*a*, such that the centrifugal force Fw applied to the mass 141 when the drum 30 is rotated is offset by the inclined side wall 156, the movement of the mass 141 may be effectively restricted and controlled even by a small intensity of the magnetic force Fm.

The inclined angle α of the inclined side wall 156 may be 5° or more and 25° or less. The inclined angle α of the inclined side wall 156 may be changed in a circumferential direction of the second inner surface 111*b*. The inclined angle α of the inclined side wall 156 may be continuously increased or reduced in the circumferential direction of the second inner surface 111*b*.

As illustrated in FIG. 10, the inclined side wall 156 includes a first section 156*a* and a second section 156*b* which have different inclined angles α1 and α2 from each other. The first section 156*a* is disposed at a position corresponding to the first inclined surface 154*a* and the second inclined surface 154*b* of the groove 150, and the second section 156*b* is disposed between the first sections 156*a*, i.e., at a position corresponding to the flat surface 154*c* of the groove 150. The inclined angle α1 of the inclined side wall 156 at the first section 156*a* of the inclined side wall 156 may be maintained to be 25°, and the inclined angle α2 of the inclined side wall 156 at the second section 156*b* thereof may be maintained to be greater than 5° and less than 25°.

If the inclined angle α of the inclined side wall 156 is changed, a direction of the supporting force Fs applied to the mass 141 by the inclined side wall 156 is changed, and thus a direction and an intensity of the force Fk generated along the inclined side wall 156 are changed. When the inclined angle α of the inclined side wall 156 is 0°, the centrifugal force Fw of the mass 141 is completely offset by the supporting force Fs applied to the mass 141 by the inclined side wall 156, and the force Fk generated along the inclined side wall 156 becomes '0'. When the inclined angle α of the inclined side wall 156 is 90°, the supporting force Fs is '0', and the force Fk generated along the inclined side wall 156 becomes maximum. If the inclined angle α of the inclined side wall 156 is increased within a range of 0 to 90°, the force Fk generated along the inclined side wall 156 is also increased, and if the inclined angle α of the inclined side wall 156 is reduced, the force Fk generated along the inclined side wall 156 is reduced. Further, since a rotational speed of the drum 30 is proportional to a square of the centrifugal force Fw, if the rotational speed of the drum 30 is increased, the force Fk generated along the inclined side wall 156 is also increased, and if the rotational speed of the drum 30 is reduced, the force Fk generated along the inclined side wall 156 is also reduced.

The magnetic force Fm generated from the magnet 160 offsets the force Fk generated along the inclined side wall 156, and thus restricts the mass 141. As the inclined angle α of the inclined side wall 156 is increased, the force Fk generated along the inclined side wall 156 is also increased, and thus the mass 141 overcomes a restrictive force of the magnetic force Fm at a relatively low rotational speed of the drum 30, and is separated from the groove 150. On the contrary to this, as the inclined angle α of the inclined side wall 156 is reduced, the force Fk generated along the inclined side wall 156 is also reduced, and thus in order for the mass 141 to overcome the restrictive force of the magnetic force Fm and to be separated from the groove 150, a relatively high rotational speed of the drum 30 is required.

As described above, since the inclined angle of the first section 156*a* is greater than that of the second section 156*b*, some of the masses 141 received in the groove 150, which are received at the first inclined surface 154*a* of the groove 150 and supported by the first section 156*a*, are separated from the groove 150 at a lower rotational speed of the drum 30, compared with the masses 141 received at the second inclined surface 154*b* of the groove 150 and supported by the second section 156*b*. This means that, in a process in which the drum 30 is accelerated, the masses 141 received in the groove 150 from those disposed at the both ends of the groove 150 to those disposed at a center portion of the groove 150 are separated, in turn, from the groove. Therefore, in the process in which the drum 30 is accelerated, the masses 141 received in the groove 150 are prevented from being caught in the groove 150 and thus being not smoothly separated from the groove 150.

The masses 141 are formed of a sphere-shaped metallic material, and disposed to be movable along the annular channel 110*a* in the circumferential direction of the drum 30, such that the unbalanced load generated at the drum when the drum 30 is rotated is offset. When the drum 30 is rotated, the centrifugal force is applied to the mass 141 in a direction in which a radius of the drum 30 is increased, and the mass 141 separated from the groove 150 performs the balancing function, while being moved along the channel 110*a*.

The masses 141 may be received and disposed in the balancer housing 110 through a process in which the masses 141 are received in the first housing 111 before the first and second housings 111 and 112 are bonded to each other, and then the first and second housings 111 and 112 are bonded to each other in a state in which the masses 141 are received in the first housing 111.

A damping fluid 170 is received in the balancer housing 110 to prevent a sudden movement of the masses 141.

The damping fluid 170 provides a resistance to the masses 141 when the force is applied to the masses 141, and thus prevents the masses 141 from being suddenly moved in the channel 110*a*. The damping fluid 170 may be oil. The damping fluid 170 serves to partially balance the drum 30 together with the masses 141 when the drum 30 is rotated.

The damping fluid 170 is received in the balancer housing 110 through a process in which the damping fluid 170 is injected into the first housing 111 together with the masses 141, and then the first and second housings 111 and 112 are bonded to each other. However, the method of receiving the damping fluid 170 in the balancer housing 110 is not limited thereto. The damping fluid 170 may be received in the balancer housing 110 through a process in which the first and second housings 111 and 112 are bonded to each other, and then the damping fluid 170 is injected into the balancer housing 110 through an injection port (not shown) formed at the first housing 111 or the second housing 112.

FIG. 14 is a view illustrating a structure in which the magnet is disposed on the balancer housing. FIG. 14 illustrates the balancer housing seen from a rear side thereof.

As illustrated in FIG. 14, the magnet 160 includes one pair of a first magnet 160*a* and a second magnet 160*b* which are disposed at a position corresponding to the groove 150 and coupled to a rear surface of the balancer housing 110.

The first magnet 160*a* and the second magnet 160*b* may be disposed so that an angle β formed by a first vertical line M vertically connecting the first magnet 160*a* and a rotational center C of the drum 30 and a second vertical line M2 vertically connecting the second magnet 160*b* and the rotational center C of the drum 30 is 150° or more and 210° or less, and preferably the angle β formed by the first vertical line M and the second vertical line M2 is 180°. When the angle β formed by the first vertical line M and the second vertical line M2 is 180°, the first magnet 160*a* and the second magnet 160*b* are disposed at positions which are symmetrical with each other with respect to the imaginary line Lr passing the rotational center of the drum 30 and vertical to the ground.

As described above, for example, under a condition that the RPM of the drum 30 does not exceed 200 rpm and the masses 141 are restricted by the magnet 160, when the number of the magnets 160 is 3 or more, if the masses 141 are caught between two magnets 160 adjacent to each other in a process in which the masses 141 are restricted, the masses 141 may not be moved to the remaining magnets 160, and thus a phenomenon in which the masses 141 may not be uniformly spread in the balancer housing 110 occurs, and the unbalanced load may be generated at the drum 30.

When one pair of magnets 160 are disposed at positions which are symmetrical to each other with respect to the imaginary line Lr passing the rotational center of the drum 30, if all of the masses 141 are received in one groove 150*a*, the masses 141 which are not received in the one groove 150*a* may be naturally received in the other groove 150*b*, while the drum 30 is rotated, and may be restricted by the magnet 160. Therefore, the phenomenon in which the masses 141 may not be uniformly spread in the balancer housing 110 does not occur.

Hereinafter, an operation principle in which the masses 141 are restricted by the groove 150 and the magnet 160, when the RPM of the drum 30 is in a particular range, and the masses 141 are separated from the groove 150, when the RPM of the drum 30 deviates from the particular range, and perform the balancing function of the drum 30 will be described.

FIGS. 15 and 16 are views illustrating the operation principle of the balancer in accordance with one embodiment of the present invention. In FIGS. 15 and 16, the damping fluid 170 is omitted.

As illustrated in FIG. 15, at an early stage of a spin-drying process of the laundry, when the RPM of the drum 30 is in the particular range, the masses 141 are received in the groove 150 or the cross section increasing portion 158, and the movement thereof is restricted by the magnets 160.

Before the spin-drying process is started, i.e., before the drum 30 is rotated, the masses 141 is in a state in which all of the masses 141 are disposed at a lower portion of the balancer housing 110 by their own weights. In this state, if the spin-drying process is started and the drum 30 is rotated, the centrifugal force is applied to the masses 141, and the masses 141 are moved along the channel 110*a* of the balancer housing 110, and received and settled in the groove 150 while being moved along the channel 110*a* of the balancer housing 110. The movement of the masses 141 received and settled in the groove 150 is restricted by the magnetic force of the magnets 160 until the RPM of the drum 30 does not deviate from the particular range. For example, if it is designed such that the centrifugal force applied to the masses 141 due to the rotation of the drum 30, the force generated by the own weights of the masses 141, the magnetic force of the magnets 160, and the force supporting the masses 141 by the groove 150 are balanced when the RPM of the drum 30 is 200 rpm, at the early stage of the spin-drying process of the laundry, when the RPM of the drum 30 is in a range of 0 to 200 rpm, the masses 141 is in the state in which the masses 141 are received and settled in the groove 150, and the movement thereof is restricted. Like this, at the early stage of the spin-drying process of the laundry, since the movement of the masses 141 is restricted when the drum 30 is rotated at the relatively low speed, the masses 141 may be prevented from generating the vibration of the drum 30 together with a laundry L, or the vibration generated by the laundry L may be prevented from being increased. Further, the noise due to the vibration of the drum 30 may be reduced.

As illustrated in FIG. 16, when the RPM of the drum 30 deviates from the particular range, the masses 141 received and restricted in the groove 150 or the cross section increasing portion 158 are separated from the groove 150 or the cross section increasing portion 158, moved along the channel 110*a* of the balancer housing 110, and performs the balancing function of the drum 30.

For example, if it is designed such that the centrifugal force applied to the masses 141 due to the rotation of the drum 30, the force generated by the own weights of the masses 141, the magnetic force of the magnets 160, and the force supporting the masses 141 by the groove 150 are balanced when the RPM of the drum 30 is 200 rpm, the centrifugal force applied to the masses 141 is increased when the RPM of the drum 30 exceeds 200 rpm, and thus the masses 141 are separated from the groove 150 or the cross section increasing portion 158 and moved along the channel 110*a* of the balancer housing 110. During this process, the masses 141 are controlled to be slid or rolled to a position which offsets an unbalanced load Fu generated at the drum 30 by a bias of the laundry L, i.e., in an opposite direction to that in which the unbalanced load Fu is applied, and a force Fa, Fb offsetting the unbalanced load Fu is generated, and thus the rotational movement of the drum 30 is stabilized.

Hereinafter, a structure in which the magnetic force of the magnet is strengthened so that the masses are reliably restricted by the magnet will be described.

FIG. 17 is a cross-sectional view illustrating a state in which the balancer in accordance with one embodiment of the present invention is installed at the drum.

As illustrated in FIG. 17, the annular recess 38 of which the front portion is opened is formed at the front plate 32 of the drum 30, and the balancer housing 110 is received in the recess 38.

A magnetic body 180 is disposed between the balancer 100 and the front plate 32. The magnetic body 180 is received in the recess 38, and disposed between the front plate 32 of the drum 30 and a rear surface of the magnet 160 coupled to a rear surface of the balancer housing 110. The magnetic body 180 may be fixed to the recess 38 or the rear surface of the magnet 160. When the magnetic body 180 is fixed to the recess 38, the balancer 100 is received in the recess 38 in a state in which the magnetic body 180 is fixed to the recess 38, and when the magnetic body 180 is fixed to the rear surface of the magnet 160, the balancer 100 is received in the recess 38 in a state in which the magnetic body 180 is fixed to the rear surface of the magnet 160.

The magnetic body 180 may be formed of a material having magnetic properties, such as iron, cobalt, and nickel, and may be formed in a thin plate shape corresponding to the magnet 160.

The magnetic force of the magnet 160 acts in all directions with respect to the magnet 160, and influences a magnetic object therearound. As the magnetic force of the magnet 160 is concentrated on an inner side of the balancer housing 110, the masses 141 may be more stably restricted. In order for the magnetic force of the magnet 160 to be concentrated on the inner side of the balancer housing 110, the magnetic force of the magnet 160 which acts in the rest directions, except the magnetic force of the magnet 160 acting on the inner side of the balancer housing 110, should be blocked. The magnetic body 180 is disposed at a rear side or a rear surface of the magnet 160 to block the magnetic force acting in the rest directions except the inner side of the balancer housing 110, such that the magnetic force of the magnet 160 is concentrated on the inner side of the balancer housing 110, and thus the masses 141 received in the balancer housing 110 may be more stably restricted by the magnet 160.

Due to such a structure in which the magnetic force of the magnet 160 is concentrated using the magnetic body 180 as described above, even though a smaller magnet 160 is used, the masses 141 may be restricted with the same force, compared with a case in which the magnetic body 180 is not used. Therefore, a material cost of the magnet 160 may be reduced. Also, since a size of the magnet 160 may be reduced, a size of the balancer 100 may be also reduced, and thus a larger volume of the drum 30 may be secured.

A thickness of the magnetic body 180 may be approximately 0.5 mm or more and 3.0 mm or less. When the thickness of the magnetic body 180 is smaller than 0.5 mm, an effect in which the magnetic force of the magnet 160 is concentrated may be reduced. When the thickness of the magnetic body 180 is greater than 3.0 mm, the effect in which the magnetic force of the magnet 160 is concentrated may be increased, but since a thickness of the balancer 100 becomes larger in a lengthwise direction of the drum 30, or an entire length of the drum 30 is increased, there is a disadvantage in securing of the volume thereof.

The magnetic body 180 may be disposed at a position corresponding to that of the magnet 160 coupled to the rear surface of the balancer housing 110, and may be disposed to be spaced in the circumferential direction of the balancer housing 110.

FIG. 18 is an exploded perspective view illustrating a coupling structure between the magnet and the balancer housing of a balancer in accordance with another embodiment of the present invention, FIG. 19 is an exploded perspective view illustrating a magnet case, a magnet, and a magnetic body extracted from FIG. 18, and FIG. 20 is a cross-sectional view illustrating a state in which the balancer in accordance with another embodiment of the present invention is installed at the drum.

As illustrated in FIGS. 18 to 20, a magnet case 262 is coupled to the rear surface of the balancer housing 110 at the rear side of the balancer housing 110 in an opposite direction to that in which the balancer housing 110 is coupled in the recess 38.

The magnet case 262 includes a plurality of magnet receiving parts 262*a*, first magnet supporting part 263 and second magnet supporting part 264 configured to support a magnet 260 received in the magnet receiving parts 262*a*, a plurality of magnet fixing hooks 285 configured to fix the magnet 260 received in the magnet receiving parts 262*a*, and a plurality of case fixing hooks 286 configured to fix the magnet case 262 to the rear surface of the balancer housing 110 in a state in which the magnet 260 is received and fixed in the magnet receiving parts 262*a*.

The plurality of magnet receiving parts 262*a* are respectively formed in a shape corresponding to the magnet 260, and at least two or more magnet receiving parts 262*a* are disposed in the circumferential direction of the balancer housing 110.

The first magnet supporting part 263 forms the magnet receiving parts 262*a*, and supports one surface 260*a* of the magnet 260 received in the magnet receiving parts 262*a*.

The second magnet supporting part 264 forms the magnet receiving parts 262*a* together with the first magnet supporting part 263, and supports a side surface 260*b* of the magnet 260 received in the magnet receiving parts 262*a*.

The first magnet supporting part 263 is formed in an arc shape, and includes a supporting surface 263*a* which supports the one surface 260*a* of the magnet 260. The second magnet supporting part 264 protrudes from the supporting surface 263*a* of the first magnet supporting part 263, and is formed to surround the side surface 260*b* of the magnet 260.

The magnet fixing hooks 285 are disposed to be spaced along the second magnet supporting part 264 and thus to uniformly fix the magnet 260 received in the magnet receiving parts 262*a*.

The case fixing hooks 286 is formed to extend from the supporting surface 263*a* of the first magnet supporting part 263 in a direction R1 in which the magnet case 262 is coupled to the balancer housing 110.

The balancer housing 110 includes a magnet case receiving part 197 which protrudes from the rear surface of the balancer housing 110 to have a shape corresponding to an exterior of the magnet case 262 and thus to receive at least part of the magnet case 262, and a plurality hooking holes 198 formed to pass through the magnet case receiving part 197 and to hook the case fixing hooks 286 therein.

The case fixing hooks 286 are coupled into the hooking holes 198 to prevent the magnet case 262 from being separated from the balancer housing 110.

The magnetic body 180 is received in the magnet receiving parts 262*a*, and disposed between the one surface 260*a* of the magnet 260 and the supporting surface 263*a* of the first magnet supporting part 263.

The magnetic body 180 may be formed of a material having magnetic properties, such as iron, cobalt, and nickel, and may be formed in a thin plate shape corresponding to the magnet 260.

Since the operation principle of the magnetic body 180, in which the magnetic force of the magnet 260 is concentrated on the inner side of the balancer housing 110, is the same as that described above, detailed description thereof will be omitted.

FIG. 21 is a view illustrating another embodiment of the magnetic body.

As illustrated in FIG. 21, a magnetic body 280 is formed in a case shape of which one side is opened, and includes a receiving part 282 formed therein to receive the magnet 160, 260. The magnetic body 280 covers all of rear and side surfaces of the magnet 160, 260, except a front surface of the magnet 160, 260 which faces the rear surface of the balancer housing 110.

As described above, since the magnetic body 280 covers all of rear and side surfaces of the magnet 160, 260, the effect in which the magnetic force of the magnet 160, 260 is concentrated may be further increased.

FIGS. 22A to 22C are views illustrating a state in which a balancer in accordance with still another embodiment of the present invention is installed at the drum. For convenience of explanation, description of the same configuration as that in the above-mentioned balancer in accordance with one embodiment of the present invention will be omitted, and like reference numerals refer to like elements throughout.

As illustrated in FIG. 22A, the magnet 160 is fixed to the front plate 32 of the drum 30. Specifically, the magnet 160 is disposed to be fixed into the recess 38 formed at the front plate 32 of the drum 30, and to be opposed to the rear surface of the balancer housing 110. Further, the magnet 160 is disposed at a position corresponding to the groove 150 formed in the balancer housing 110 in a circumferential direction of the recess 38.

The magnet 160 may be fixed into the recess 38 through an adhesive material (not shown). A worker may coat the adhesive material on one surface 38*a* of the recess 38, which is opposed to the rear surface of the balancer housing 110, and then may fix the magnet 160 to the in the one surface 38*a* of the recess 38.

As illustrated in FIG. 22B, the recess 38 may further include a receiving groove 38*b* which receives the magnet 160. The receiving groove 38*b* is formed to be recessed concavely from the one surface 38*a* of the recess 38 opposed to the rear surface of the balancer housing 110 toward an inner side of the drum 30, and disposed at a position corresponding to the groove 150.

As illustrated in FIG. 22C, a magnet fixing member 190 configured to fix the magnet 160 into the recess 38 may be coupled into the recess 38. The magnet fixing member 190 may be fixed into the recess 38 in a state in which the magnet fixing member 190 receives the magnet 160.

The magnet fixing member 190 includes a receiving and supporting part 192 formed in a shape corresponding to the magnet 160 to receive and support the magnet 160, and a fixing part 194 fixed into the recess 38. The fixing part 194 may be directly fixed to the one surface 38*a* of the recess 38 through the adhesive material (not shown). Although not illustrated in the drawings, a hook may be formed at the fixing part 194, and a hook hole in which the hook is coupled may be formed at the one surface 38*a* of the recess 38, and thus the magnet fixing member 190 may be hooked to the one surface 38*a* of the recess 38.

Like the balancer housing 110, the magnet fixing member 190 may be fabricated by an injection molding using the plastic material such as PP and ABS.

FIGS. 23A to 23C are views illustrating a state in which a balancer in accordance with yet another embodiment of the present invention is installed at the drum. For convenience of explanation, description of the same configuration as that in the above-mentioned balancer in accordance with one embodiment of the present invention will be omitted, and like reference numerals refer to like elements throughout.

As illustrated in FIG. 23A, the magnetic body 180 is disposed between the magnet 160 and the front plate 32 of the drum 30. The magnetic body 180 is fixed into the recess 38 formed at the front plate 32 of the drum 30, and coupled to one surface of the magnet 160 opposite to the other surface of the magnet 160 facing the rear surface of the balancer housing 110.

As illustrated in FIG. 23B, the recess 38 may further include a receiving groove 38*c* which receives the magnet 160 and the magnetic body 180. The receiving groove 38*c* is formed to be recessed concavely from the one surface 38*a* of the recess 38 opposed to the rear surface of the balancer housing 110 toward the inner side of the drum 30, and disposed at a position corresponding to the groove 150.

As illustrated in FIG. 23C, a magnet fixing member 290 configured to fix the magnet 160 and the magnetic body 180 into the recess 38 may be coupled into the recess 38. The magnet fixing member 290 may be fixed into the recess 38 in a state in which the magnet fixing member 290 receives the magnet 160 and the magnetic body 180.

The magnet fixing member 290 includes a receiving and supporting part 292 formed in a shape corresponding to the magnet 160 and the magnetic body to receive and support the magnet 160 and the magnetic body 180, and a fixing part 294 fixed into the recess 38. The fixing part 294 may be directly fixed to the one surface 38*a* of the recess 38 through the adhesive material (not shown). Although not illustrated in the drawings, a hook may be formed at the fixing part 294, and a hook hole in which the hook is coupled may be formed at the one surface 38*a* of the recess 38, and thus the magnet fixing member 290 may be hooked to the one surface 38*a* of the recess 38.

Like the first housing 111 and the second housing 112 forming the balancer housing 110, the magnet fixing member 290 may be fabricated by an injection molding using the plastic material such as PP and ABS.

Although a few embodiments of the present invention have been shown and described, it would be appreciated by those skilled in the art that changes may be made in these embodiments without departing from the principles and spirit of the invention, the scope of which is defined in the claims and their equivalents.

The invention claimed is:

1. A washing machine comprising:

a cabinet;

a drum disposed in the cabinet to be rotatable;

a balancer installed at the drum to offset an unbalanced load generated at the drum when the drum is rotated; and at least one magnetic body disposed between the balancer and the drum, wherein the balancer comprises a balancer housing having an annular channel formed therein, at least one mass disposed in the channel to be movable, and at least one magnet provided at one side of the balancer housing to restrict a movement of the mass along the channel when a rotational speed of the drum is in a particular range, and wherein the magnetic body is disposed between a front surface of the drum and the magnet to block a magnetic force of the magnet acting in rest directions except an inner side of the balancer housing, such that the magnetic force of the magnet is concentrated on the inner side of the balancer housing.

2. The washing machine according to claim 1, wherein the drum comprises a cylindrical part, a front plate disposed at a front portion of the cylindrical part, and a recess formed at the front plate, and the magnetic body is disposed inside the recess.

3. The washing machine according to claim 1, wherein the magnetic body is formed in a shape corresponding to the magnet.

4. The washing machine according to claim 1, wherein the magnetic body is formed in a plate shape.

5. The washing machine according to claim 1, wherein the magnetic body is formed in a case shape of which one side is opened.

6. The washing machine according to claim 1, wherein at least two or more magnetic bodies are disposed to be spaced in a circumferential direction of the balancer housing.

7. The washing machine according to claim 1, wherein the balancer comprises a magnet case configured to receive the magnet, and the magnetic body is received in the magnet case.

8. The washing machine according to claim 7, wherein the magnetic body is disposed between the magnet and the magnet case.

9. The washing machine according to claim 1, wherein a thickness of the magnetic body is 0.5 mm or more and 3 mm or less.

10. A balancer of a washing machine, which offsets an unbalanced load generated at a drum of the washing machine, comprising:

a balancer housing installed at least one of a front surface and a rear surface of the drum and having a channel configured to extend in a circumferential direction of the drum;

a plurality of masses disposed to be movable along the channel;

at least one magnet disposed at a rear side of the balancer housing to restrict the plurality of masses when an RPM (revolutions per minute) of the drum is in a particular range; and at least one magnetic body disposed at a rear side of the magnet to block a magnetic force of the magnet acting in rest directions except an inner side of the balancer housing, such that the magnetic force of the magnet is concentrated on the inner side of the balancer housing.

11. The balancer according to claim 10, further comprising a magnet case configured to receive the magnet and the magnetic body and coupled to a rear surface of the balancer housing.

12. The balancer according to claim 10, wherein the magnetic body is formed in a plate shape.

13. The balancer according to claim 10, wherein the magnetic body comprises a receiving part configured to receive the magnet.

* * * * *